US006045428A

United States Patent [19]

Anderson et al.

[11] Patent Number: 6,045,428

[45] Date of Patent: Apr. 4, 2000

[54] APPARATUS AND METHOD FOR CLEANING AN ELECTRON GUN OF A CATHODE RAY TUBE

[75] Inventors: Leslie L. Anderson; Vitale M. Sgambelluri, both of San Diego; Andree J. Pyfer, Encinitas, all of Calif.

[73] Assignees: Sony Corporation of Japan, Tokyo, Japan; Sony Electronics, Inc., Park Ridge, N.J.

[21] Appl. No.: 09/258,245

[22] Filed: Feb. 25, 1999

[51] Int. Cl.[7] ..... H01J 9/02

[52] U.S. Cl. ..... 445/60

[58] Field of Search ..... 445/60

[56] References Cited

U.S. PATENT DOCUMENTS 3,323,854 6/1967 Palac ..... 445/60

*Primary Examiner*—Kenneth J. Ramsey

*Attorney, Agent, or Firm*—Wagner, Murabito & Hao LLP

[57] ABSTRACT

A method and apparatus for cleaning an electron gun of a CRT wherein said method and apparatus prevents damage to the CRT's during the cleaning process. A protective cap is placed over the pins of an assembled CRT for protecting the pins against damage. The CRT is then lowered into a container that is filled with dielectric-fluid. A socket that includes a central opening is disposed in the container. The pins of the CRT are electrically coupled to the socket. The dielectric-fluid is circulated through the central opening of the socket so as to remove any air trapped between the stem base surface of the CRT and the protective cap. A high voltage electrical current is then selectively applied to the pins for cleaning the electron gun of the CRT.

20 Claims, 6 Drawing Sheets

APPARATUS AND METHOD FOR CLEANING AN ELECTRON GUN OF A CATHODE RAY TUBE

TECHNICAL FIELD

The present claimed invention relates to the field of displays. More particularly, the present invention relates to a method and apparatus for cleaning an electron gun of a CRT.

BACKGROUND ART

Cathode Ray Tube (CRT) displays typically include a screen that is sealed to a glass tube. The glass tube tapers to a neck region in which an electron gun is disposed. The electron gun is sealed within the neck region of the glass tube such that pins extend from the rear glass surface of the neck region. In operation, electrical power and input is coupled to the electron gun through the pins. The electron gun generates three electron beams that are scanned across the screen such that the beams strike phosphors that coat the inside of the screen. These phosphors then emit red, green, and blue light so as to generate a viewable display.

In a typical prior art process for manufacturing a CRT, once the CRT is assembled, a glass straw that extends from the rear glass surface of the CRT is used to evacuate the CRT. The glass straw is then melted, forming a seal that maintains a vacuum within the CRT. A protective cap is then typically placed over the pins for protecting the pins during subsequent process steps and during shipping, handling, and assembly into a final product. This protective cap is commonly referred to as a "base cap."

In one prior art process, high voltage electrical current is applied to the pins of the CRT to clean the electron gun. More particularly, some of the pins are coupled to ground and some are coupled to a high voltage electrical current. The electrical current arcs from charged regions to regions that are grounded, striking and vaporizing contaminant particles.

Such prior art methods require the application of a high voltage electrical current in order to effectively clean the CRT's electron gun. However, when surrounded by air, electrical arcing will occur between pins of the CRT's electron gun before the electrical current reaches the "high level" required to effectively clean the electron gun. This premature arcing also frequently results in damage to the CRT. To prevent such premature arcing between the pins of the CRT, prior art processes typically lower the neck of the CRT into a dielectric-fluid. However, air is often trapped between the protective cap and the stem base surface of the CRT. The trapped air allows for the deleterious premature arcing to occur between the pins on the outside of the CRT. This arcing produces heat, which, combined with mechanical stress resulting from the electric field between high voltage and positive ground, mechanically stresses the fillet glass, cracking the glass. This results in a defective CRT that must be scrapped. The resulting defective CRT's reduce manufacturing yield and result in increased manufacturing costs.

What is needed is an apparatus and method for cleaning an electron gun of a CRT that will reduce or eliminate the number of CRT's damaged during the cleaning process. Also, a method and apparatus is needed that meets the above requirement and that will prevent arcing between pins outside of the CRT during the cleaning process. The present invention provides an elegant solution to the above needs.

DISCLOSURE OF THE INVENTION

The present invention provides a method and apparatus for cleaning an electron gun of a Cathode Ray Tube (CRT) that prevents damage to the CRT during cleaning of the electron gun. More particularly, the present invention provides an apparatus and method that eliminates arcing that occurs between the stem pins at the stem base surface of the CRT and the protective cap during the cleaning process.

A cleaning station is disclosed that is adapted to clean an electron gun of a CRT. In one embodiment, the cleaning station includes a container within which a socket is disposed. Dielectric-fluid is disposed in the container such that the dielectric-fluid covers the socket. The socket has an opening formed within it, and the opening is coupled to a circulation system. The circulation system circulates dielectric-fluid through the opening in the socket. The socket includes receptacles that are adapted to be coupled to the pins of a CRT.

As each CRT is fabricated, a protective cap is placed on the CRT. The protective cap fits over the pins and the glass straw that extend from the CRT. The CRT is then inserted into the cleaning station such that the pins are disposed under the dielectric-fluid and such that the pins engage the receptacles of the socket. The circulation of dielectric-fluid through the socket removes any air trapped between the stem base surface of the CRT and the protective cap. A high voltage electrical current is then applied to the pins of the CRT. The high voltage electrical current vaporizes contaminant particles, thereby cleaning the electron gun.

The method and apparatus of the present invention reduces the number of CRT's damaged during the cleaning process. More particularly, by removing any air that is trapped between the stem base surface of the CRT and the protective cap, arcing between pins outside of the CRT during the cleaning process is eliminated. This increases yield and saves money as compared to prior art processes because fewer CRT's are damaged during the cleaning process.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

The drawings referred to in this description should be understood as not being drawn to scale except if specifically noted.

BEST MODE FOR CARRYING OUT THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well-known methods, procedures, components, and circuits have not been described in detail as not to unnecessarily obscure aspects of the present invention.

EXEMPLARY CATHODE RAY TUBE

Figure 1:
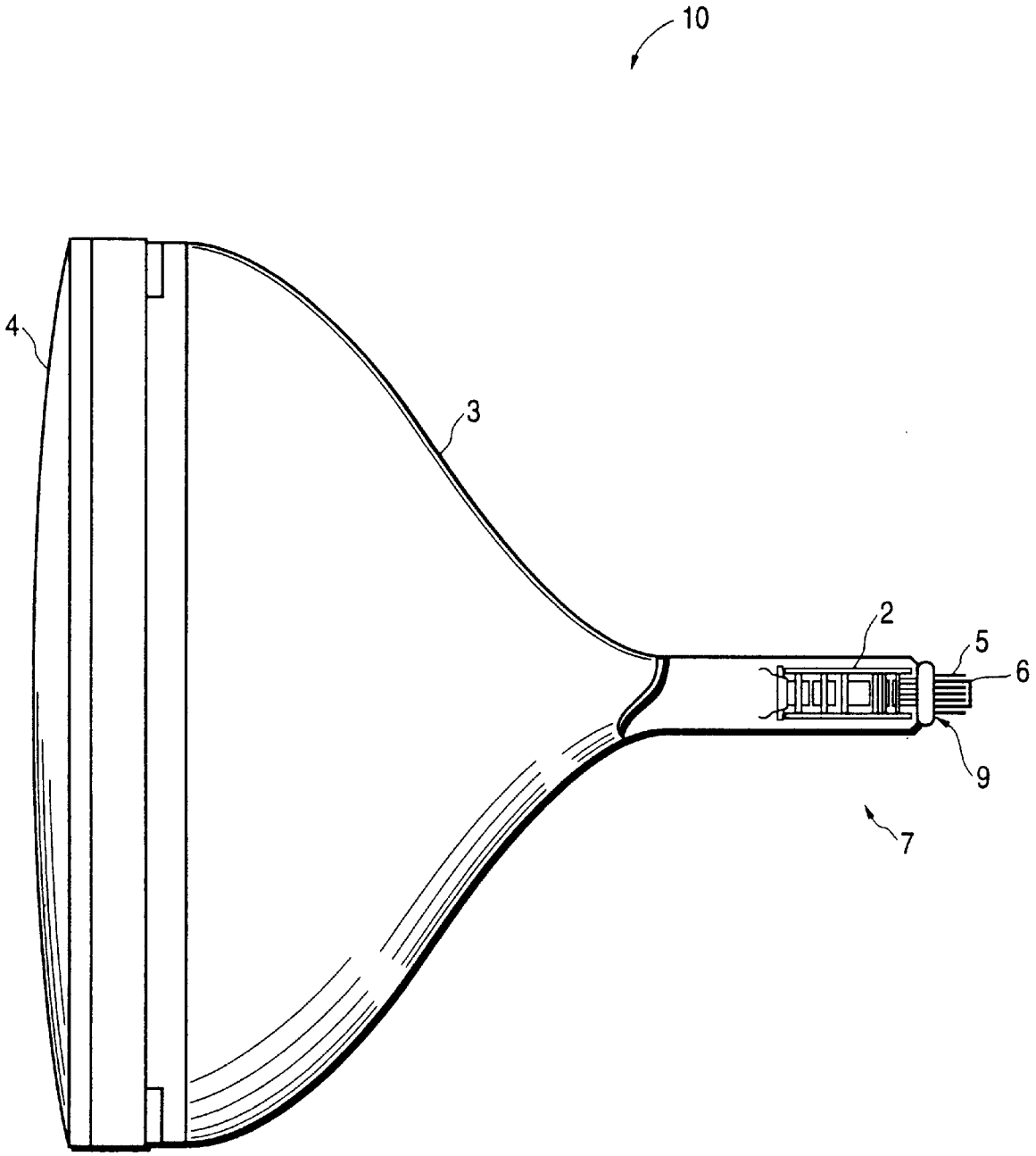
FIG. 1 is a diagram illustrating a cut-away side view of an exemplary cathode ray tube in accordance with one embodiment of the present claimed invention.

The method and apparatus of the present invention is adapted to clean a Cathode Ray Tube (CRT) such as CRT 10 shown in FIG. 1. However, it will be appreciated that the method and apparatus of the present invention is well adapted for cleaning other configurations of CRT's. Referring now to FIG. 1, CRT 10 is shown to include a screen 4 that is sealed to a glass tube 3. Glass tube 3 forms a seal around electron gun 2 such that pins 5 extend from the stem base surface 9 of neck region 7. In one embodiment, stem base surface 9 is a glass fillet integrally formed over pins 5 that is sealed to glass tube 3. However, alternatively, stem base surface 9 may be a surface of glass tube 3.

Continuing with FIG. 1, pins 5 extend in a circular fashion around glass straw 6. During the manufacture of CRT 10, glass straw 6 is used to evacuate glass tube 3. Once glass tube 3 is evacuated, glass straw 6 is melted so as to maintain a vacuum within CRT 10.

Still referring to FIG. 1, in operation, electrical power and input is coupled to electron gun 2 through pins 5. Electron gun 2 generates three electron beams that are scanned across screen 4 such that the beams strike phosphors that coat the inside of screen 4. These phosphors then emit red, green, and blue light so as to generate a display on screen 4.

CLEANING STATION

Figure 2:
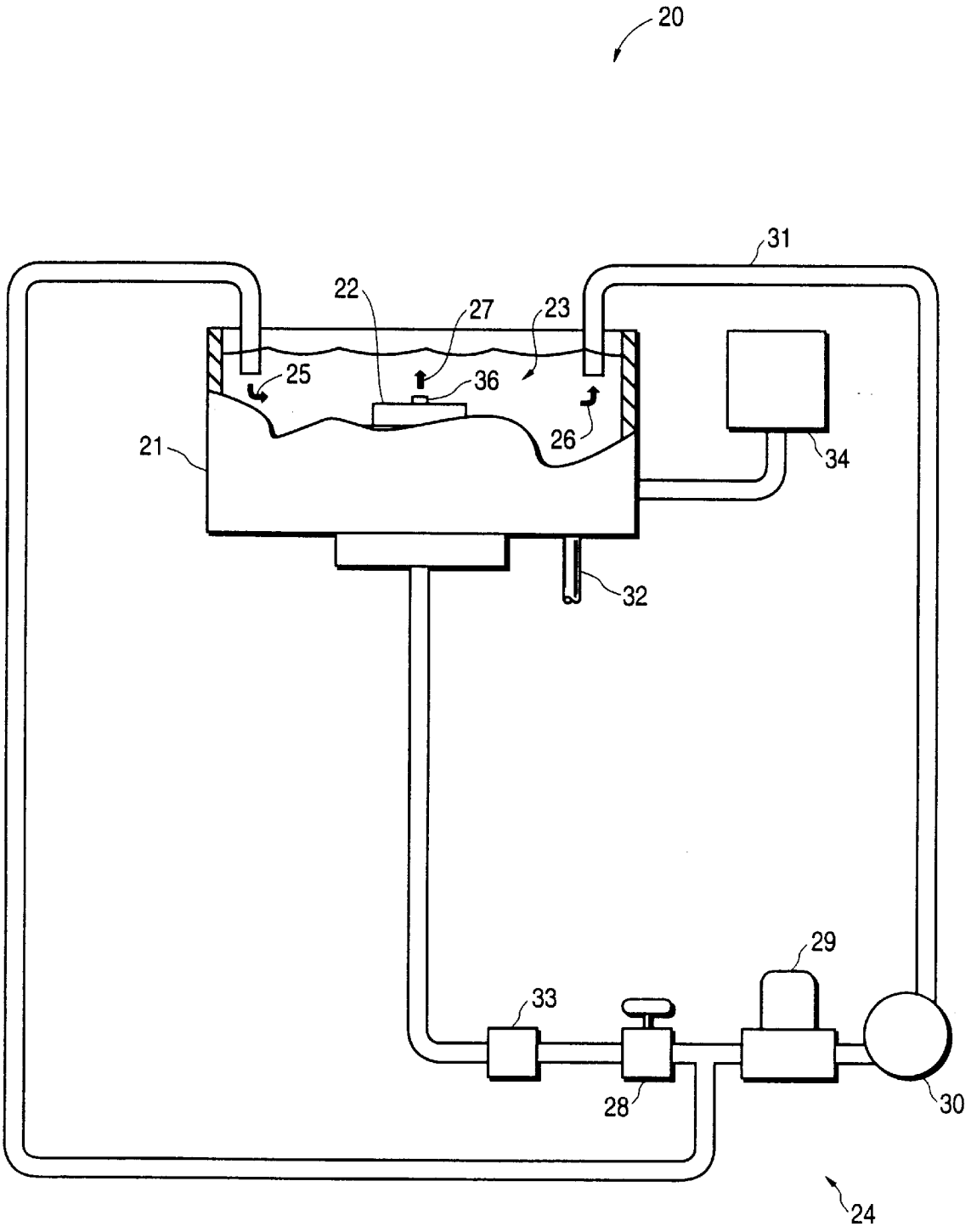
FIG. 2 is a diagram illustrating a cut-away front view of a cleaning station in accordance with one embodiment of the present claimed invention.

Referring now to FIG. 2, a cleaning station 20 for cleaning an electron gun of a CRT is shown. Cleaning station 20 includes container 21 within which socket 22 is disposed. Dielectric-fluid 23 is also disposed within container 21. In one embodiment, Flourinert, a dielectric-fluid that can be purchased from 3M Corporation of St. Paul, Minn., is used as dielectric-fluid 23. However, alternatively, any of a number of other fluids that are not electrically conductive can also be used. Electrical cable 32 couples to socket 22 and to a power source (not shown) for providing high voltage electrical current. A circulation system 24 circulates dielectric-fluid 23 in the direction shown by arrows 25–27.

Continuing with FIG. 2, in one embodiment, circulation system 24 includes pump 30 that circulates dielectric-fluid 23 through tubing, shown generally as tubing 31. Tubing 31, in turn, is coupled to the center of socket 22. Reservoir 34 holds additional dielectric-fluid 23 that is provided, as needed, for maintaining the proper level of dielectric-fluid 23 in container 21. Filter 29 removes impurities from dielectric-fluid 23. In one embodiment, filter 29 is a one micron filter. Valve 28 is used to control the flow of dielectric-fluid 23 through center of socket 22. In one embodiment, valve 28 is operated so as to assure that from 0.2 liters per minute to 0.5 liters per minute of dielectric-fluid 23 flows through the center of socket 22. Alarm 33 monitors the flow of dielectric-fluid 23 for assuring that a sufficient amount of dielectric-fluid 23 passes through the opening in socket 22. In one embodiment, when the amount of dielectric-fluid 23 flowing through socket 22 is below 0.2 liters per minute, the alarm sounds.

Figure 3:
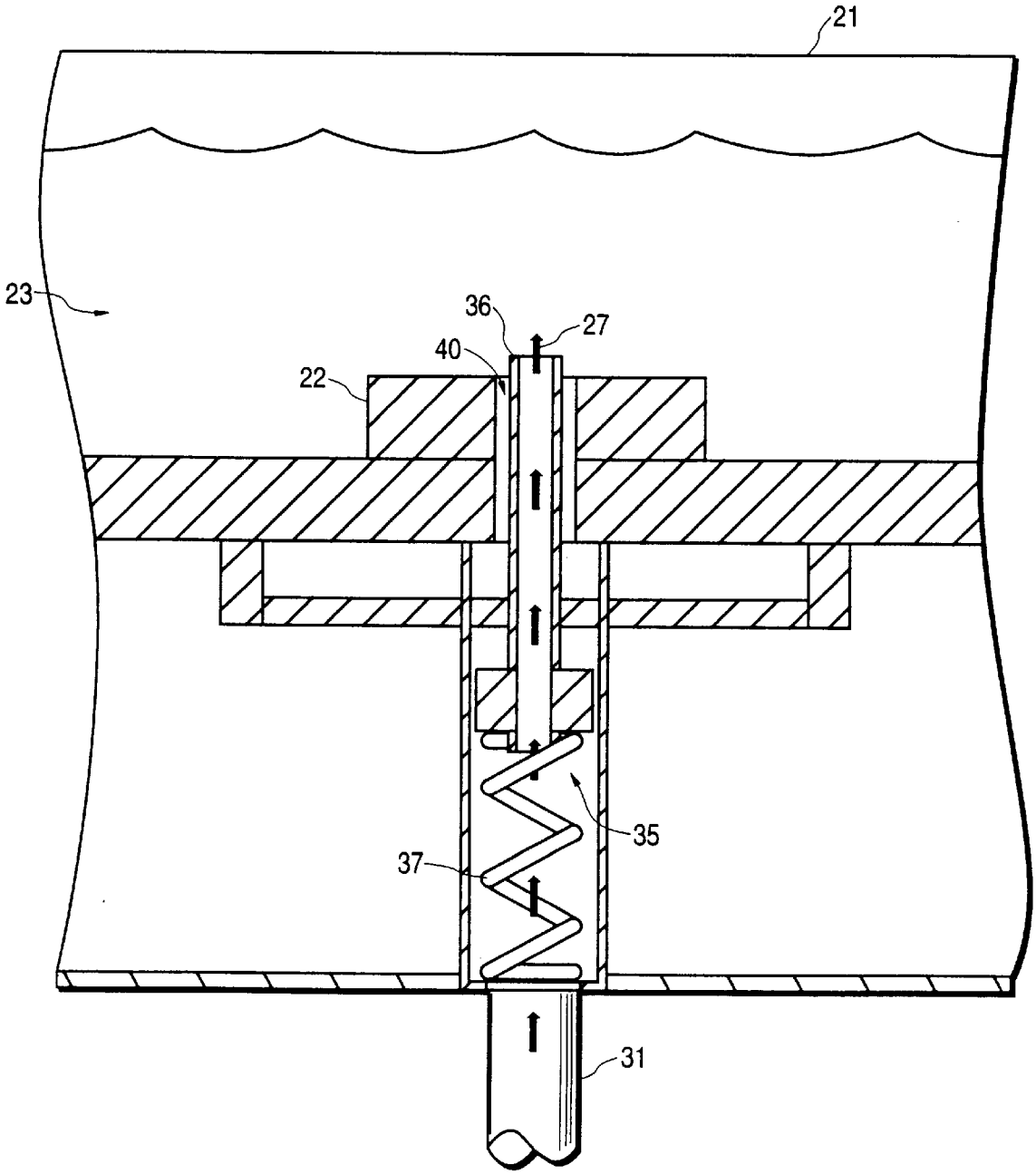
FIG. 3 is a cross sectional diagram of a cleaning station that includes a push rod assembly in accordance with one embodiment of the present claimed invention.
Figure 4:
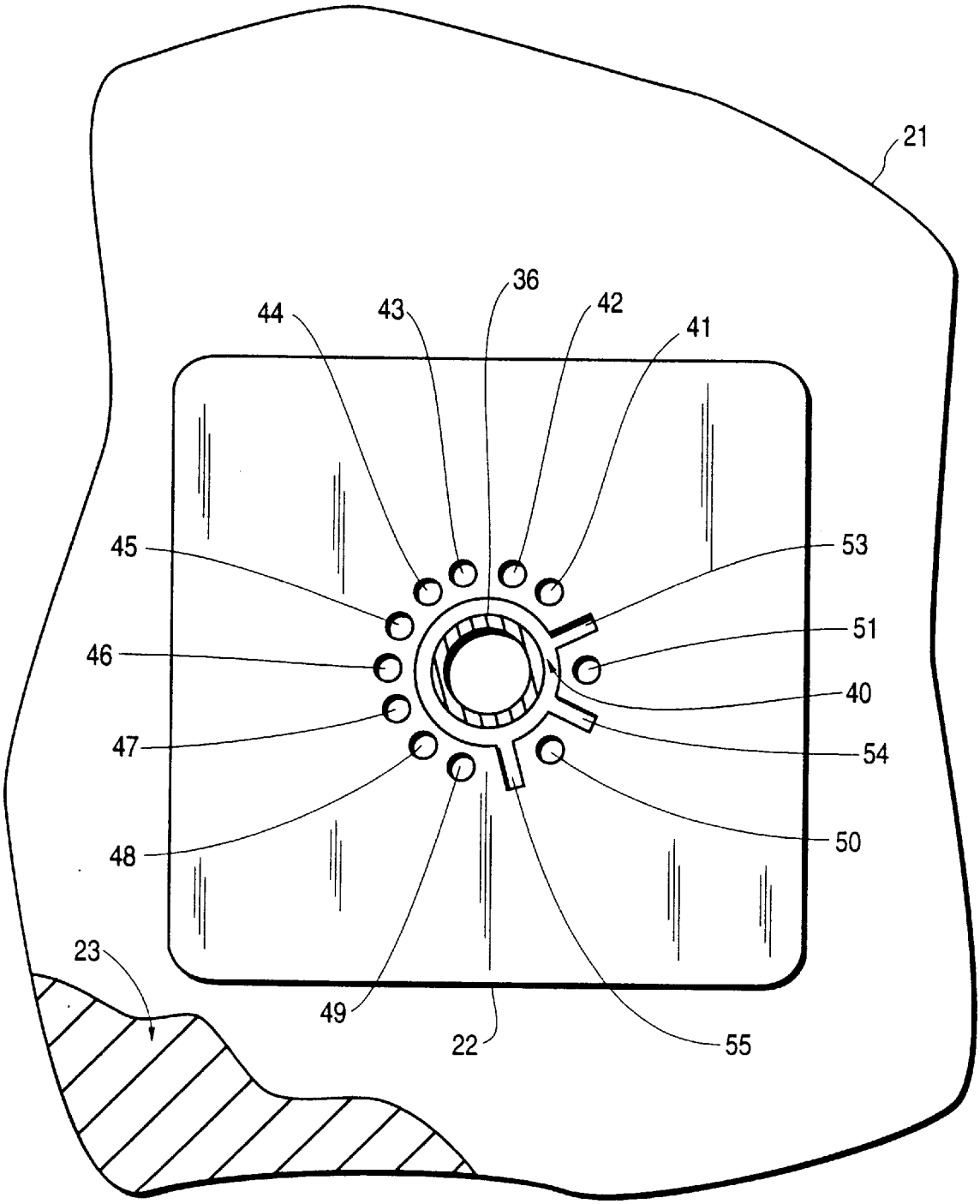
FIG. 4 is a top view of a cleaning station that includes a push rod assembly in accordance with one embodiment of the present claimed invention.

In one embodiment that is shown in FIGS. 2–4, a push rod assembly 35 is used for controlling extraction. Push rod assembly 35 includes push rod 36 and spring 37. Push rod 36 is disposed above spring 37 such that push rod 36 can travel up and down within a limited range. When push rod 36 is fully extended, push rod 36 extends through opening 40 of socket 22. Dielectric-fluid 23 flows through the hollow tubular center of push rod 36, as shown by arrow 27. Because push rod 36 has a hollow center, and because dielectric-fluid 23 can flow through the center of spring 37, push rod assembly 35 allows for effective flow of dielectric-fluid 23 through opening 40 of socket 22.

Referring now to FIG. 3, push rod 36 facilitates extraction when a CRT is inserted into socket 22. That is, when a CRT is inserted into socket 22, push rod 36 is forced downward, compressing spring 37. When the CRT is to be removed, push rod 36 exerts an upward force, assisting the removal of the CRT. This facilitates removal of the CRT and prevents the CRT's base cap from getting stuck in socket 22.

As shown in FIG. 4, socket 22 includes a central opening 40 around which connector receptacles 41–51 are disposed. When a push rod such as push rod 36 of FIG. 3 is used for controlling extraction, push rod 36 will extend within opening 40. However, it will be appreciated that the method and apparatus of the present invention can be practiced without the use of a push rod assembly. In an embodiment that does not include a push rod assembly (not shown), dielectric-fluid 23 flows freely through central opening 40 of FIG. 4.

Continuing with FIG. 4, slots 53–55 extend into socket 22 for alignment control. Connector receptacles 41–51 are adapted to receive pins of a CRT such as, for example, pins 5 of CRT 10 shown in FIG. 1. In one embodiment, connector receptacles 41–49 are connected to a source of high voltage electrical current (not shown) and connector receptacles 50–51 are connected to ground. However, alternatively, any of a number of other configurations can be used for coupling high voltage electrical current to the CRT to be cleaned, depending on the configuration of the electron gun that is to be cleaned and the design of the CRT.

METHOD FOR CLEANING AN ELECTRON GUN OF A CRT

Figure 5:
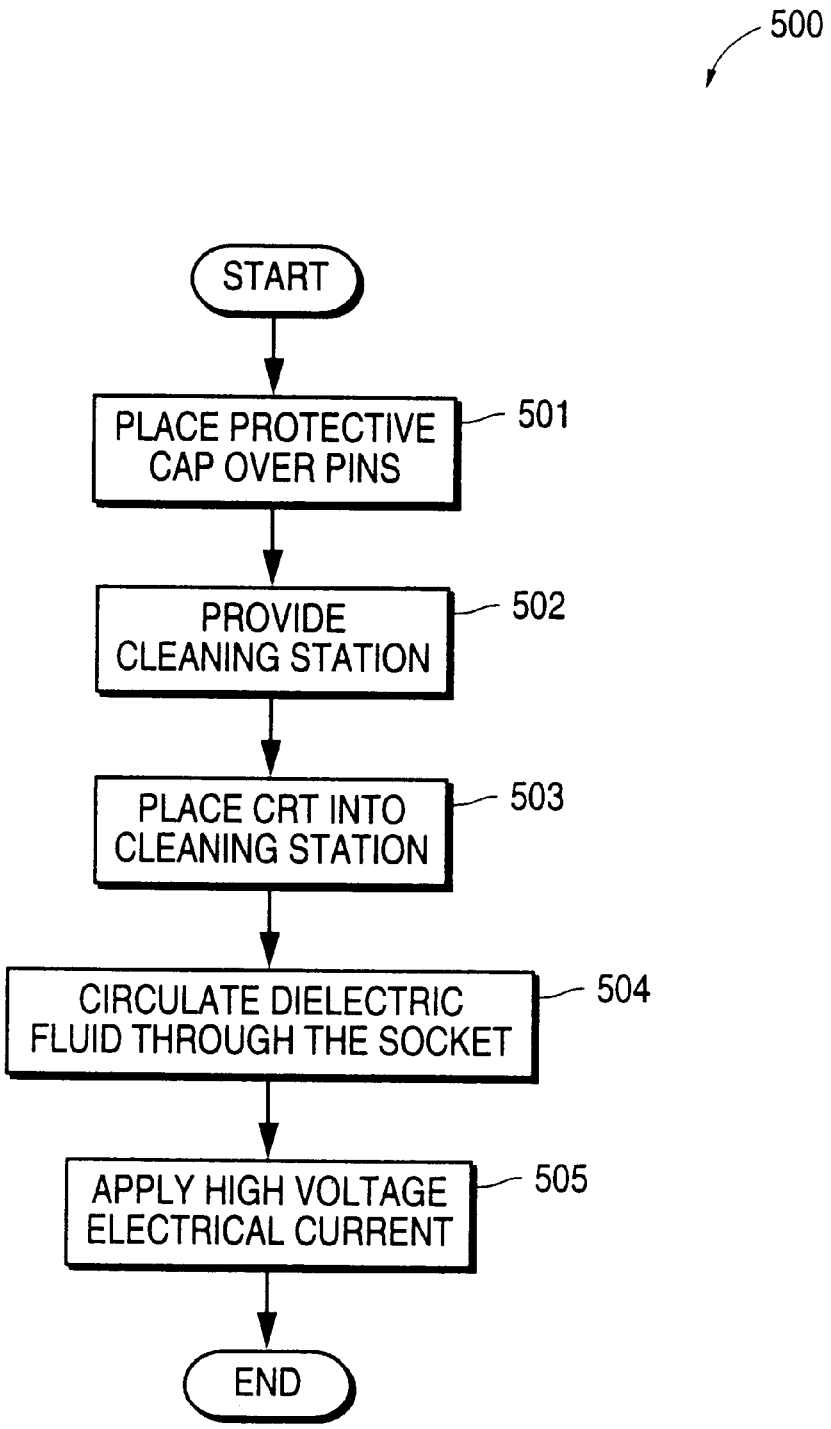
FIG. 5 is a flow chart illustrating a method for cleaning an electron gun of a CRT in accordance with one embodiment of the present claimed invention.

Flow chart 500 of FIG. 5 illustrates a method for cleaning an electron gun of a CRT in accordance with one embodiment of the present invention. As shown by step 501, a protective cap is placed over the pins of the CRT. The protective cap protects the pins from damage during post-manufacture processing steps and during shipping, handling, and assembly into the final product.

Figure 6:
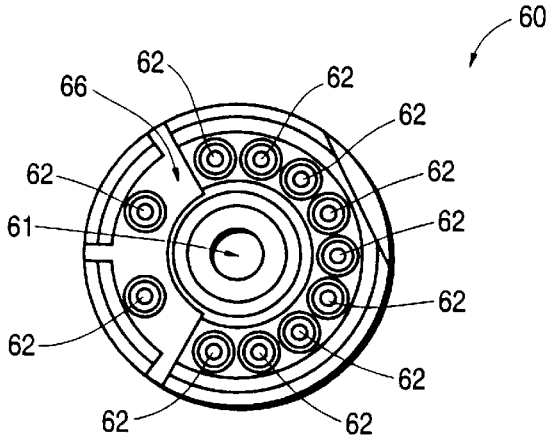
FIG. 6 is a front view of a protective cap in accordance with one embodiment of the present claimed invention.
Figure 7:
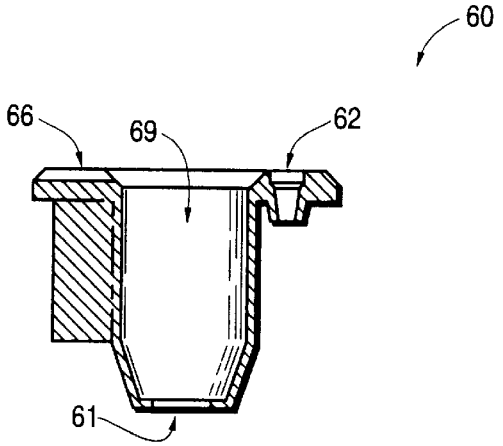
FIG. 7 is a side cross sectional view of a protective cap along section BB—BB of FIG. 8 in accordance with one embodiment of the present claimed invention.
Figure 8:
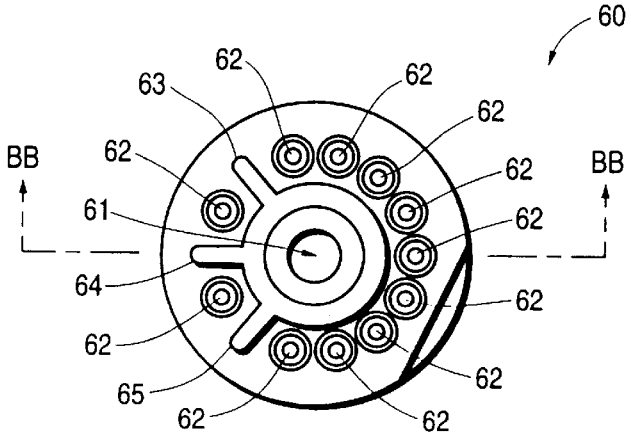
FIG. 8 is a rear view of a protective cap in accordance with one embodiment of the present claimed invention.

FIGS. 6–8 show an embodiment of a protective cap 60 that is adapted to cover pins 5 of CRT 10 shown in FIG. 1. Protective cap 60 is sometimes referred to as a "base cap." Protective cap 60 includes opening 69 and openings 62. Openings 62 are adapted to receive each of pins 5 shown in FIG. 1. Protective cap 60 also includes a center open region 69 that is adapted to receive glass straw 6 shown in FIG. 1. In one embodiment, protective cap 60 is made of clear plastic material.

In the embodiments shown in FIGS. 1–4 and FIG. 6, step 501 of FIG. 5 is performed by placing protective cap 60 over stem base surface 9 of FIG. 1 such that front surface 66 fits against stem base surface 9. Once protective cap 60 is properly placed, each of pins 5, also of FIG. 1, will fit through a respective one of openings 62.

Referring now to FIG. 7, the length of protective cap 60 is less than the length of pins 5 of FIG. 1 near each of openings 62. Thus, once protective cap 60 is properly inserted over pins 5, each of pins 5 will extend through protective cap 60.

As shown in FIG. 8, in one embodiment, protective cap 60 includes keys 63–65. Keys 63–65 are adapted to fit within slots 53–55 shown in FIG. 4. Thus, when a CRT covered by a protective cap 60 is inserted into socket 22 of FIGS. 2–4, proper alignment is insured. This prevents improper insertion that can damage the pins of the CRT.

As shown in step 502 of FIG. 5, a cleaning station is provided. In one embodiment, cleaning station 20 of FIGS. 2–4 is used. However, the present invention is also well suited for other configurations of cleaning stations that include a dielectric-fluid filled container, a socket adapted to provide high voltage electrical current and a circulation system for circulating dielectric-fluid through the socket.

Referring back to FIG. 5, a CRT is placed into the cleaning station as is shown by step 503. In the embodiments shown in FIGS. 1–4 and 6, when CRT 10 of FIG. 1 is inserted into cleaning station 20 of FIGS. 2–4, pins 5 will be completely immersed within dielectric-fluid 23. Keys 63–65 of FIG. 6 fit within slots 53–55 of FIG. 4, such that proper alignment is obtained as each of pins 5 also of FIG. 1 engages one of receptacles 41–51 of FIG. 4.

As shown by step 504 of FIG. 5, dielectric-fluid is circulated through the socket of the cleaning station. In one embodiment, dielectric-fluid is constantly circulated through the socket. However, alternatively, flow may be initiated once insertion is complete. The circulation of dielectric-fluid through the socket forces dielectric-fluid through the openings in the protective cap, removing any air trapped between the stem base surface of the CRT and the protective cap. More particularly, in the embodiment shown in FIGS. 1–4 and FIG. 6, the dielectric-fluid flows through openings 61 and 62 of FIG. 6 and between stem base surface 9 of FIG. 1 and front surface 66 of FIG. 6 for removing any air trapped therebetween.

High voltage electrical current is then applied to the pins of the CRT as shown by step 505 of FIG. 5. In the embodiments shown in FIGS. 1–4, high voltage electrical current is provided to pins 5 of CRT 10 via receptacles 41–51. In one embodiment, an electrical current of between 25,000 Volts and 30,000 Volts is applied to ones of receptacles 41–51 such that some regions of the electron gun are connected to ground and other regions receive high voltage electrical current. In the embodiment shown in FIG. 4, connector receptacles 41–49 are connected to high voltage electrical current and connector receptacles 50–51 are connected to ground. However, any of a number of different configurations can be used for coupling high voltage electrical current to the CRT to be cleaned, depending on the configuration of the electron gun that is to be cleaned and the design of the CRT. The application of high voltage electrical current cleans the electron gun by vaporizing contaminant particles on the electron gun.

The apparatus and method of the present invention removes any air that is trapped between the stem base surface of the CRT and the protective cap. Therefore, arcing between pins outside of the CRT during the cleaning process is prevented. This reduces the number of CRT's damaged during the cleaning process as compared to prior art processes. Thus, the apparatus and method of the present invention increases yield and saves money as compared to prior art processes because fewer CRT's are damaged during the cleaning process.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

We claim:

1. A cleaning station for a Cathode Ray Tube (CRT) comprising:

a container having dielectric-fluid disposed therein;

a socket disposed in said container, said socket having an opening formed therein, said socket adapted to be coupled to the pins of a CRT for selectively supplying high voltage electrical current to said pins of said CRT; and a circulation system coupled to said container, said circulation system coupled to said socket, said circulation system adapted to circulate said dielectric-fluid such that said dielectric-fluid flows through said opening in said socket.

2. The cleaning station for said CRT of claim 1 further comprising:

receptacles disposed in said socket, said receptacles adapted to receive said pins, and wherein said opening in said socket is disposed centrally within said socket.

3. The cleaning station for said CRT of claim 1 wherein said circulation system further comprises a pump and a filter.

4. The cleaning station for said CRT of claim 1 wherein said circulation system is adapted to flow from approximately 0.2 liters per minute to approximately 0.5 liters per minute of dielectric-fluid through said opening in said socket.

5. The cleaning station for said CRT of claim 1 wherein said circulation system further includes a valve, said valve adapted to regulate a flow rate of said dielectric-fluid through said opening in said socket.

6. The cleaning station for said CRT of claim 1 wherein said circulation system further includes a flow measurement device and an alarm, said flow measurement device adapted to measure a flow rate of said dielectric-fluid through said opening in said socket, said flow measurement device coupled to said alarm such that, when said flow rate of said dielectric-fluid through said opening in said socket is below a predetermined threshold, said alarm is activated.

7. The cleaning station for said CRT of claim 1 wherein said dielectric-fluid comprises Flourinert.

8. The cleaning station for said CRT of claim 1 further comprising:

a push rod having an opening disposed therein, said push rod adapted to be disposed within said opening in said socket; and a spring disposed below said push rod, said spring adapted to be compressed such that, upon the insertion of a cathode ray tube in said socket, said push rod compresses said spring.

9. A method for cleaning a Cathode Ray Tube (CRT) having pins, said method comprising:

a) providing a cleaning station, said cleaning station including a dielectric-fluid filled container and a socket adapted to provide high voltage electrical current, said cleaning station further including a circulation system for circulating said dielectric-fluid through said socket;

b) disposing a cathode ray tube into said dielectric-fluid filled container such that said pins electrically couple to said socket;

c) circulating dielectric-fluid through said socket; and d) selectively applying a high voltage electrical current to said pins.

10. The method for cleaning a CRT as recited in claim 9 further comprising the step of:

e) placing a protective cap over said pins; and f) removing any air trapped between said CRT and said protective cap by circulating said dielectric-fluid through said socket.

11. The method for cleaning a CRT as recited in claim 10 further comprising the step of:

g) filtering said dielectric-fluid.

12. The method for cleaning a CRT as recited in claim 10 further comprising the step of:

g) monitoring a flow rate of said dielectric-fluid; and h) controlling said flow rate so as to maintain said flow rate sufficient to remove any air trapped between said CRT and said protective cap.

13. The method for cleaning a CRT as recited in claim 9 wherein said dielectric-fluid further comprises flourinert.

14. The method for cleaning a cathode ray tube as recited in claim 12 wherein step h) further comprises maintaining a flow rate of from approximately 0.2 liters per minute to approximately 0.5 liters per minute.

15. A method for cleaning an electron gun of a cathode ray tube (CRT) that includes pins, said method comprising:

a) placing a protective cap over said pins;

b) a providing a cleaning station, said cleaning station including a dielectric-fluid filled container and a socket adapted to provide high voltage electrical current, said cleaning station further including a circulation system for circulating said dielectric-fluid through said socket;

c) disposing a cathode ray tube into said dielectric-fluid filled container such that said pins electrically couple to said socket;

d) circulating said dielectric-fluid such that said dielectric-fluid removes any air trapped between said CRT and said protective cap; and e) selectively applying a high voltage electrical current to said pins so as to clean said electron gun.

16. The method for cleaning an electron gun of a CRT as recited in claim 15 further comprising the step of:

f) filtering said dielectric-fluid.

17. The method for cleaning an electron gun of a CRT as recited in claim 16 further comprising the step of:

g) monitoring the flow of said dielectric-fluid so as to determine a flow rate of said dielectric-fluid; and h) controlling said flow rate of said dielectric-fluid so as to maintain said flow rate sufficient to remove any air trapped between said CRT and said protective cap.

18. The method for cleaning an electron gun of a CRT as recited in claim 17 wherein step g) further includes the steps of:

g1) circulating said dielectric-fluid through a flow measurement device; and g2) generating an audible alarm when said flow rate indicated by said flow measurement device is below a predetermined threshold.

19. The method for cleaning an electron gun of a CRT as recited in claim 17 wherein said flow rate is from approximately 0.2 liters per minute to approximately 0.5 liters per minute through said socket.

20. The method for cleaning an electron gun of a CRT as recited in claim 15 wherein said dielectric-fluid further comprises flourinert.

* * * * *